US005620177A

United States Patent [19]

Takemoto et al.

[11] Patent Number: 5,620,177

[45] Date of Patent: Apr. 15, 1997

[54] PAPER SLIP STORAGE SYSTEM

[75] Inventors: Takatoshi Takemoto, Tokyo; Noriaki Kano; Eiji Ito, both of Iwate-ken; Tsutomu Onodera, Hanamaki; Kozo Sekimoto, Sendai, all of Japan

[73] Assignee: Kabushiki Kaisha Ace Denken, Tokyo, Japan

[21] Appl. No.: 347,455

[22] PCT Filed: May 26, 1993

[86] PCT No.: PCT/JP93/00701

§ 371 Date: Feb. 8, 1995

§ 102(e) Date: Feb. 8, 1995

[87] PCT Pub. No.: WO93/24402

PCT Pub. Date: Dec. 9, 1993

[30] Foreign Application Priority Data

Jun. 3, 1992 [JP] Japan ..... 4-142987

[51] Int. Cl.[6] ..... B65H 43/00

[52] U.S. Cl. ..... 271/176; 271/178; 271/315

[58] Field of Search ..... 271/178, 177, 271/315, 176

[56] References Cited

FOREIGN PATENT DOCUMENTS

| | | | |
|---|---|---|---|
| 55-35023 | 8/1953 | Japan . | |
| 55-141877 | 3/1954 | Japan . | |
| 46-9285 | 3/1971 | Japan . | |
| 51-141697 | 12/1976 | Japan . | |
| 57-2625 | 1/1982 | Japan . | |
| 57-27857 | 2/1982 | Japan . | |
| 58-212546 | 12/1983 | Japan . | |
| 61-150959 | 7/1986 | Japan . | |
| 61-267620 | 11/1986 | Japan | 271/315 |
| 63-117874 | 5/1988 | Japan . | |
| 64-53983 | 3/1989 | Japan . | |
| 4354757 | 12/1992 | Japan | 271/178 |

*Primary Examiner*—David H. Bollinger
*Attorney, Agent, or Firm*—Lowe, Price, LeBlanc & Becker

[57] ABSTRACT

A paper slip storage system having a paper slip storage container (20) being placed in conjunction with a transport mechanism for storing transported paper slips is disclosed. The system has a temporary housing section (33), a rotational displacement mechanism (30, 80), and a separation mechanism (60). The temporary housing section (33) receives a transported paper slip M and temporarily houses it. The rotational displacement mechanism (30, 80) rotationally displaces the housing section for guiding the paper slip housed therein to a paper slip storage position of the paper slip storage container (20). The separation mechanism (60) blocks rotation of the paper slip housed in the temporary housing section against operation of rotational displacement of the temporary housing section and separates the paper slip from the temporary housing section at the paper slip storage position of the paper slip storage container.

22 Claims, 8 Drawing Sheets

PAPER SLIP STORAGE SYSTEM

TECHNICAL FIELD

This invention relates to a paper slip storage system for storing transported paper slips in a paper slip storage container and in particular to a paper slip storage system appropriate for storing bills, installed in a gaming house.

TECHNICAL BACKGROUND

A conventional paper slip storage system is, for example, as shown in FIG. 7.

When paper slips M are transported to a temporary storage section 1, they are pushed to the inside of a paper slip storage container 2 communicated with the temporary storage section 1 by means of a push plate 3 for performing a push operation from the outside to inside of the paper slip storage container 2. When the push plate 3 is restored to the outside, shutters 4 at the entrance of the paper slip storage container 2, which open and close prevent the paper slips from returning to the temporary storage section 1, so that they are kept inside the paper slip storage container 2. The paper slips in the paper slip storage container 2 are pushed towards the opening and closing shutters 4 by a paper slip pressure spring 5 so that the notes are properly arranged.

In such a conventional paper slip storage system, however, when paper slips M are stored in the paper slip storage container 2, the push plate 3 reciprocates between the outside and inside of the paper slip storage container 2, thus a space for the push plate 3 to reciprocate is required outside the paper slip storage container 2. For this reason, the installation space of the paper slip storage system becomes large. For example, to place such a paper slip storage system in the inside of a gaming machine island in a gaming house, a large space is required; effective use cannot be made of space.

DISCLOSURE OF INVENTION

It is therefore an object of the invention to provide a paper slip storage system which only requires a compact space for installation so that effective use can be made of limited space.

To this end, according to one form of the invention, there is provided a paper slip storage system having a paper slip storage container being placed in conjunction with a transport mechanism for storing transported paper slips, wherein the improvement comprises:

a temporary housing section for receiving a transported paper slip and temporarily housing it;

a rotational displacement mechanism for rotationally displacing the temporary housing section for guiding the paper slip housed therein to a paper slip storage position of the paper slip storage container; and a separation mechanism for blocking rotation of the paper slip housed in the temporary housing section against operation of rotational displacement of the temporary housing section and separating the paper slip from the temporary housing section at the paper slip storage position of the paper slip storage container, the rotational displacement mechanism having a rotation body and a drive mechanism for rotationally driving the rotation body, the paper slip storage container having an area for stacking and storing paper slips separated from the temporary housing section and a mechanism being provided under said area for pressing the stacked paper slips in a direction of said rotation body, the paper slip pressing mechanism pressing the paper slips so that the uppermost one of the stacked paper slips comes into contact with an outer peripheral surface of said rotation body.

The rotational displacement mechanism can have a rotation body and a drive mechanism for rotationally driving the rotation body. For example, a rotation drum is used as the rotation body.

The temporary storage section can have a structure in which a length in a rotation shaft direction of the rotation body is shorter than a length in the same direction of a paper slip housed in the temporary storage section.

The temporary housing section can have a slit-like opening along an axial direction of the rotation body and a depth, when a paper slip is housed, sufficient to allow a part of the paper slip to protrude outward therefrom, Wherein insertion of a paper slip is accepted from one end of the rotation body and the paper slip is discharged through the slit-like opening.

Also, a plurality of the temporary housing sections can be provided, in which case they are equally spaced on the rotation body, for example.

The separation mechanism can consist of a paper slip stop member for blocking tangential movement of a paper slip, the paper slip stop member being placed at a position abutting against a part of a paper slip protruding outward from the temporary housing section when the temporary housing section is at the paper slip storage position of the paper slip storage container. For example, two paper slip stop members can be provided and placed on both outsides of a rotation passage position of the temporary housing section.

The invention can further include a clamp mechanism for temporarily fixing and holding a paper slip housed in the temporary housing section while the paper slip is guided to the paper slip storage position of the paper slip storage container after it is received.

The invention can further include a first sensor for detecting the temporary housing section being at a position where it can receive a paper slip. The invention can further include a second sensor for detecting the temporary housing section housing a paper slip.

The invention can further include a controller which controls the drive mechanism so as to stop rotation of the rotation body upon receipt of a detection signal of the first sensor and controls the drive mechanism so as to rotate the rotation body upon receipt of a detection signal of the second sensor.

The temporary housing section temporarily houses a transported paper slip. The rotational displacement mechanism rotates the housing section with the paper slip fixed by the clamp mechanism, for example, for guiding the paper slip to a paper slip storage position of the paper slip storage container. The separation mechanism blocks rotation of the paper slip housed in the temporary housing section against rotational displacement of the temporary housing section and separates the paper slip from the temporary housing section at the paper slip storage position of the paper slip storage container, whereby the paper slip is left at the paper slip storage position and stored in the paper slip storage container.

Therefore, according to the paper slip storage system of the invention, a space for only housing the rotational displacement mechanism would enable paper slips to be stored in the paper slip storage container. Thus, the installation space of the paper slip storage system can be made compact for effective use of space, which is particularly advantageous, for example, in the inside of a gaming machine island in which the paper slip storage system is installed.

BEST MODE FOR CARRYING OUT THE INVENTION

Referring now to the accompanying drawings, there is shown one embodiment of the invention.

Figure 1:
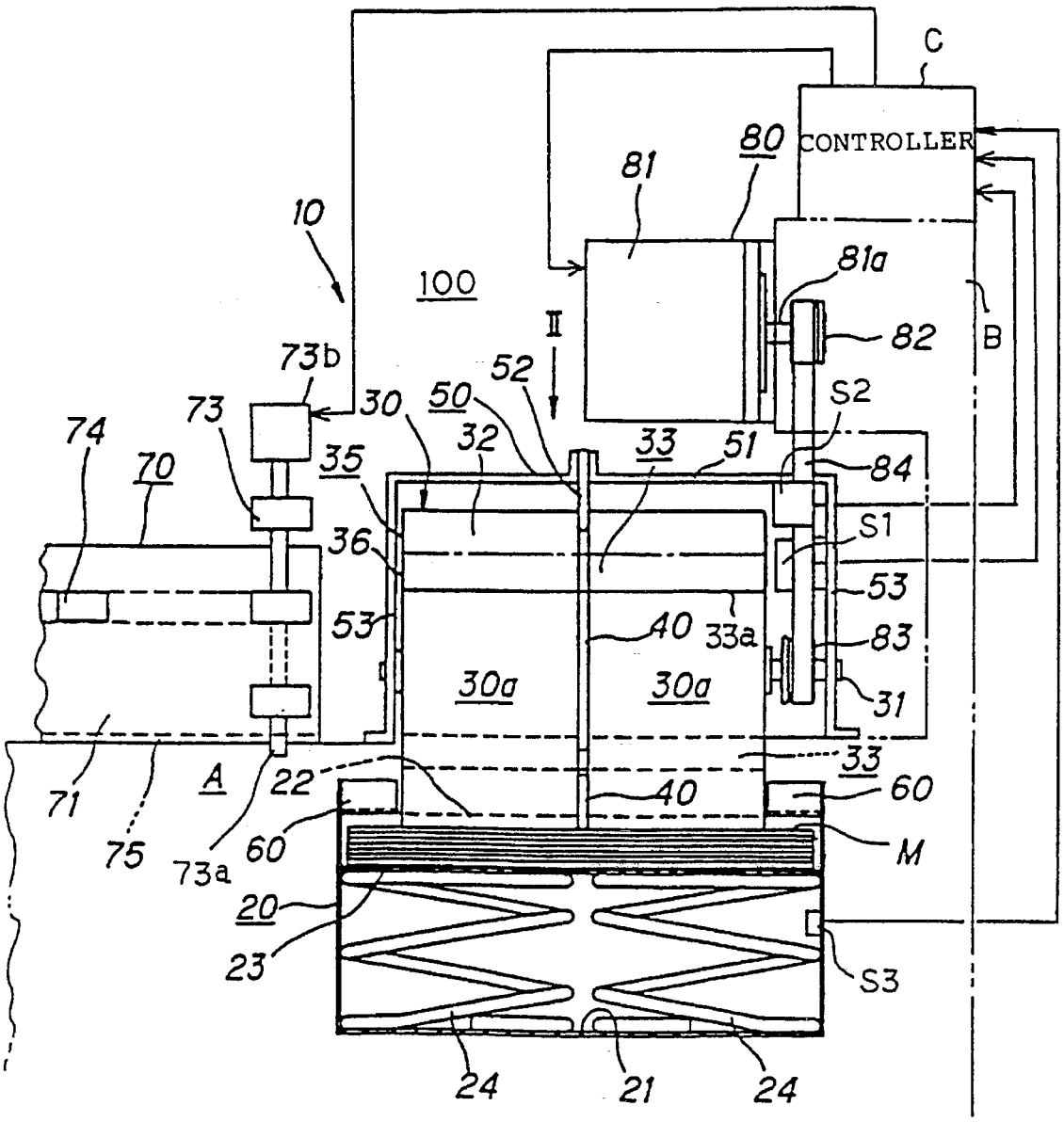
FIG. 1 is a fragmentary longitudinal sectional view showing a paper slip storage system according to one embodiment of the invention.
Figure 2:
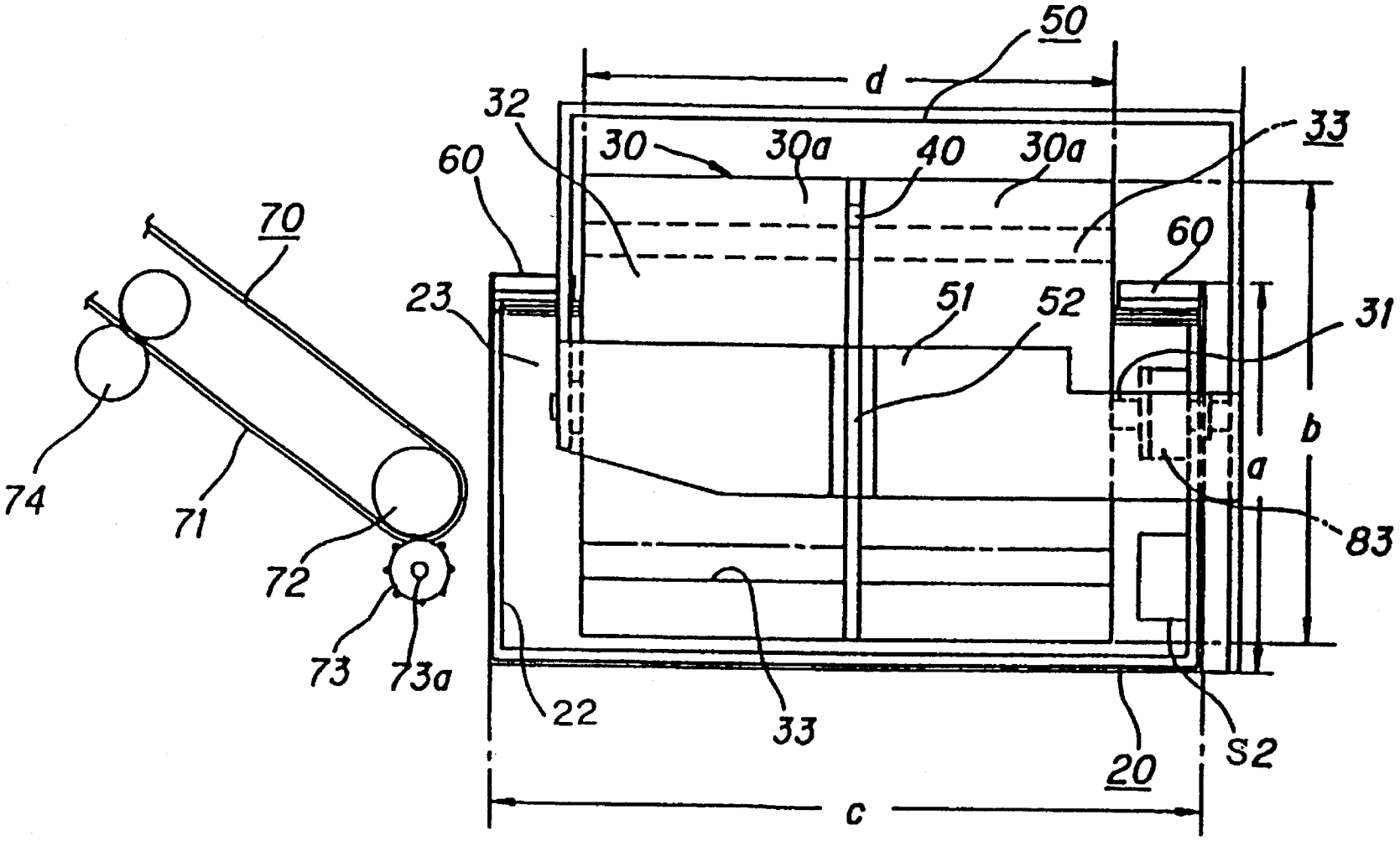
FIG. 2 is a plan view showing the paper slip storage system according to the embodiment of the invention.
Figure 3:
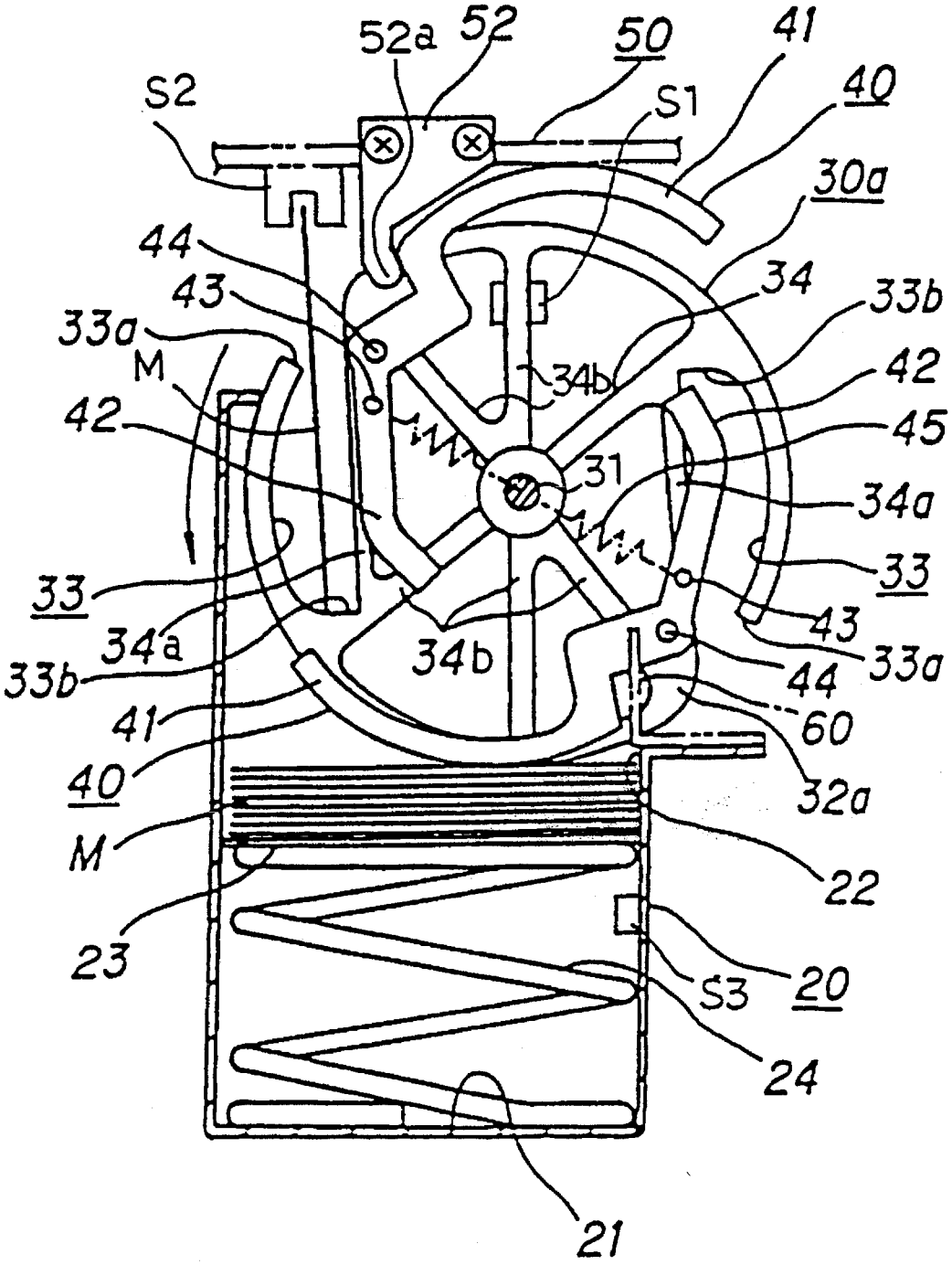
FIG. 3 is a transverse sectional view illustrating the operation of the paper slip storage system according to the embodiment of the invention.

As shown in FIGS. 1 to 3, a paper slip storage system 10 of the embodiment comprises a paper slip storage container 20 for stacking and storing paper slips transported by a paper slip transport mechanism 70, a rotation drum 30 having channels 33, each channel functioning as a temporary housing section, for receiving paper slips M from the paper slip transport mechanism 70 and rotationally displacing the channels 33 for guiding the paper slip M housed in the channel to a paper slip storage position of the paper slip storage container, paper slip stop members 60 functioning as a separation mechanism for blocking the paper slip M housed in the channel 33 so that the paper slip does not rotate further with rotational displacement of the rotation drum 30 and for separating the paper slip M from the temporary housing section at the paper slip storage position of the paper slip storage container 20, and a pair of pressure arm members 40 and 40 functioning as a clamp mechanism for pressing the paper slip M in the channel 33. The paper slip storage system of the embodiment also has the paper slip transport mechanism 70, a controller C which controls the rotation operation of the rotation drum, and sensors S1 and S2. The components of the embodiment are basically installed on a base A.

As shown in FIGS. 1 and 3, the paper slip storage container 20 is a container substantially like a rectangular parallelopiped having sides in the length direction of the container, one side being higher than the opposite side, a bottom 21, and an opening 22 provided in the upper end of the lower side. Paper pressure springs 24 are provided inside the container 20. The paper slip storage container 20 has an internal form which allows paper slips M such as bills to be housed with the slips stacked from the bottom 21 up to the opening 22 and an internal sectional area of at least a size which allows the paper slips to be housed with the slips spread out. The size of the opening 22 of the paper slip storage container 20 is represented by the length of the side in the length direction (lateral direction), c, and the length of the side in the direction (vertical direction) perpendicular to that side, a. (See FIG. 2.)

A drive mechanism 80 consists of an electric motor 81, pulleys 82 and 83, and an endless belt 84. The electric motor 81 is fixed to a support bracket B mounted upright on the base A. The pulley 82 is fixed to a drive shaft 81*a* of the electric motor 81 and the pulley 83 is fixed to a spindle 31 of the rotation drum 30. The endless belt 84 is placed on pulleys 82 and 83. The rotation drum 30 is rotated on the spindle 31 by power from the drive mechanism 80.

The rotation drum 30 is mounted on a frame-like bracket 50 that can be installed on the base A. The frame-like bracket 50 has a top face 51 and sides 53 and 53. The rotation drum 30 is placed so that the downward portion of a cylindrical face 32 faces the opening 22 of the paper slip storage container 20. Also, the rotation drum 30 is placed with the spindle 31 parallel to the length of the paper slip storage container 20. The spindle 31 is supported by the sides 53 and 53 so as to be able to rotate.

As shown in FIG. 2, the rotation drum 30 has a diameter b longer than the vertical length of the paper slip storage container 20, a, and an axial length d shorter than the lateral length of the paper slip storage container 20, c. Therefore, in the embodiment, the rotation drum 30 is placed with a radial part of the drum sticking out from the paper slip storage container 20 in the horizontal direction, for example, as shown in FIG. 3.

In the embodiment, the rotation drum 30 comprises two subdrums 30*a* and 30*a* combined on one shaft 31. A clearance for swingably housing a pair of pressure arm members 40 and 40 is formed between the subdrums 30*a* and 30*a*. The pressure arms 40 and 40 together with a plate member 52 serve as a clamp mechanism for restraining paper slips M.

The rotation drums 30 have two axial channels 33 and 33 each functioning as a paper slip housing section for temporarily housing a paper slip M. The channels 33 each have a discharge port 33*a* opened like a slit on the cylindrical face 32. Each channel 33 is formed over the axial length of the rotation drum 30. The channels 33 are communicated with one end 35 of the rotation drum 30 and a taking-in port 36 is formed at the end 35. The two channels 33 are at positions symmetrical with each other with respect to the rotation.

As shown in FIG. 3, each channel 33 is located almost along the circumference of the rotation drum 30 from the discharge port 33*a* to channel bottom 33*b*. That is, in the embodiment, the circumference is divided into four equal parts and the insides of the circular arcs of the two opposed sectors of the four parts are used as the channels. The depth is smaller than the height of a housed paper slip M, but is made so as not to bend the paper slip. In the embodiment, it is designed to be about two thirds of the height of a paper slip M.

Each channel 33 is made up of the inner face of the rotation drum 30 and a separation plate 34*a*. The rotation drum 30 contains a plurality of radial reinforcing plates 34*b* formed integrally from the spindle 31 to the cylindrical face 32. The cylindrical face 32 has a pressure part 32*a* like a curved surface formed on the boundary with the separation plate 34*a*.

The rotation drum 30 comprises two pressure arm members 40 and 40 corresponding to two channels 33 and 33.

Each pressure arm member 40 is swingably supported by a shaft 44 in the side of the pressure part 32*a* at the inner end face where the subdrums 30*a* and 30*a* face each other. The pressure arm member 40 holds a paper slip so that it does not slip out of the channel 33.

The tip of one end of each pressure arm member 40 forms a working end 42 for clamping a paper slip M. The working end 42 is displaced between a hold position for pressing a paper slip M to the inner wall of the channel 33 and a release position overlapping the separation plate 34 for releasing the paper slip M. The tip of the other end of each pressure arm member 40 forms a cam end 41 for swingingly displacing the working end 42 between the hold and release positions. The cam end 41 extends like a curve along the cylindrical face 32 and engages a tip 52*a* of a plate member 52 (described below) to adjust the swinging of the working end 42. The cam end 41 is provided So that it can protrude outward from the cylindrical face 32 of the rotation drum 30.

A pin part 43 protrudes in the vicinity of the shaft 44 on the side of one end of each pressure arm member 40. A spring member 45 is extended between each pin member 43, 43 and a hub 31*a* of the spindle 31. The spring member 45 urges the working end 42 of each pressure arm member 40 in the direction of the release position.

The plate member 52 engaging the end margin of the cam end 41 of the pressure arm member 40 is locked on the top face 51 of the frame-like bracket 50. The end margin of the cam end 41 of the pressure arm member 40 engages the tip 52*a* of the plate member 52, whereby the cam end 41 of the pressure arm member 40 is pushed to the inside of the rotation drum 30 and the working end 42 is displaced and fixed to the hold position for temporary regulation.

As shown in FIG. 3, the paper slip stop members 60 are located at position which block passage of a paper slip M housed in the channel 33, on both sides of the rotation drum 30, at the upper end of the side of the paper slip storage container 20 from which the rotation drum 30 projects. The paper slip stop member 60*s* are at positions, When the rotation drum 30 rotates, striking against a paper slip M in the channel 33 moving with the rotation of the rotation drum 30, thus blocking the movement of the paper slip M, whereby the paper slip M is stored in the paper slip storage container 20.

The paper slip pressure springs 24 are two coil springs urging to the opening 22 side so as to press paper slips M in the paper slip storage container 20 towards the rotation drum 30 side and are located on the full bottom 21 of the paper slip storage container 20. A paper slip holding plate 23 parallel to the bottom 21 is locked on the top end of the paper slip pressure springs 24.

As shown in FIG. 1 and FIG. 2, the paper slip transport mechanism 70 has an endless belt 71, pulleys 72, a roller 73, transport rollers 74, and a paper slip transport passage 75. The endless belt 71, which is placed on the pulleys 72, is parallel to the bottom 21 of the paper slip storage container 20 and is slanting.

The roller 73 is placed so as to abut against the endless belt 71 at the position of the pulley 72. It is fixed to a rotation shaft 73*a*. Several pairs of transport rollers 74 are placed along the endless belt 71 with the endless belt 71 between them. The paper slip transport passage 75 is formed along the endless belt 71 and communicated with the taking-in port 36 of the channel 33.

As shown in FIG. 1, a drive 73*b* such as a motor for rotationally driving the rotation shaft 73*a* is connected to the rotation shaft 73*a*. The drive 73*b*, which is included in the transport mechanism, is controlled by the controller C (described below) for functioning so as to push a paper slip into the channel 33 of the rotation drum 30.

The sensor S1 consists of a proximity switch, etc., for sensing whether or not the channel 33 is at a position where a paper slip can be received from the transport mechanism. Specifically, it can be made of a magnetic sensor, a microswitch, or the like. To use a magnetic sensor, a magnet or the like is fitted to a specific position of the end of the drum and when the magnet reaches the specific position, the magnetic sensor senses it and detects angular displacement of the rotation drum and the position of the channel 33. To use a microswitch, a protrusion is provided at a specific position of the end of the rotation drum and when the protrusion reaches the specific position, the microswitch operates in response to it.

Preferably, at least two sensors S1 are placed at different angle positions for accurately stopping the rotation drum 30. That is, preferably the rotation drum can be controlled so that it decelerates at the first angle position and stops at the second position.

The sensor S2 is located on the outside of one end of the rotation drum 30, that is, the end of the side where the taking-in port does not exist for sensing whether or not a paper slip M is housed in the channel 33. For example, the sensor S2 is made of a photo interrupter. The photo interrupter consists of a light emitting element and a light receiving element opposed to it and detects an obstacle by using the fact that the obstacle would hinder light from the light emitting element from being incident on the light receiving element. In the embodiment, a paper slip corresponds to the obstacle.

A sensor S3 is installed in the paper slip storage container 20 for detecting a given amount of paper slips being housed in the paper slip storage container 20. Specifically, for example, a microswitch may be placed on the inner wall of the paper slip storage container 20 so that when the paper slip pressure springs 24 are pressed and displaced and the displacement reaches a given amount, a part of the spring comes into contact with the microswitch.

The controller C is made of, for example, a microcomputer and controls driving of the drive mechanism 80 of the rotation drum 30 and the drive 73*b* of the transport mechanism 70 based on information from the sensors S1 and S2.

Next, the function of the embodiment will be discussed.

In FIGS. 3 to 6, a sequence in which the paper slip storage system 10 stores paper slips M is shown in stages.

As shown in FIGS. 1 and 3, when the rotation drum 30 approaches an angle at which the channels 33 of the rotation drum 30 become vertical positions, the sensor S1 detects it. When receiving a detection signal of the sensor S1, the controller C stops the motor 81 of the drive mechanism 80 and starts the drive 73*b* of the paper slip transport mechanism 70, whereby a paper slip M moves together with movement of the endless belt 71 and enters the channel 33 through the taking-in port 36 of the channel 33, whereby the rotation drum 30 takes the paper slip M transported on the paper slip transport passage 75 into the channel 33 through the taking-in port 36 for housing it. At this time, the working end 42 of the pressure arm member 40 corresponding to the channel 33 in which the paper slip M is housed is placed at the release position by urging force of the spring member 45 and therefore the pressure arm member 40 does not hinder the paper slip M from entering the channel 33.

When the paper slip M is housed completely in the channel 33, the sensor S2 detects it and its detection signal is sent to the controller C. Upon receipt of the signal, the controller C stops the drive 73*b* and starts the drive motor 81.

Next, the drive mechanism 80 shown in FIG. 1 causes the electric motor 81 to rotate the spindle 31 of the rotation drum 30 in the arrow direction shown in FIG. 3 via the drive shaft 81*a*, the pulley 82, the endless belt 84, and the pulley 83. That is, powered by the drive mechanisms 80, with the paper slip M housed in the channel 33, the rotation drum 30 rotates on the spindle 31 in the direction with the channel bottom 33*b* of the channel 33 leading and the taking-in port 33*a* thereof trailing (counterclockwise).

Figure 4:
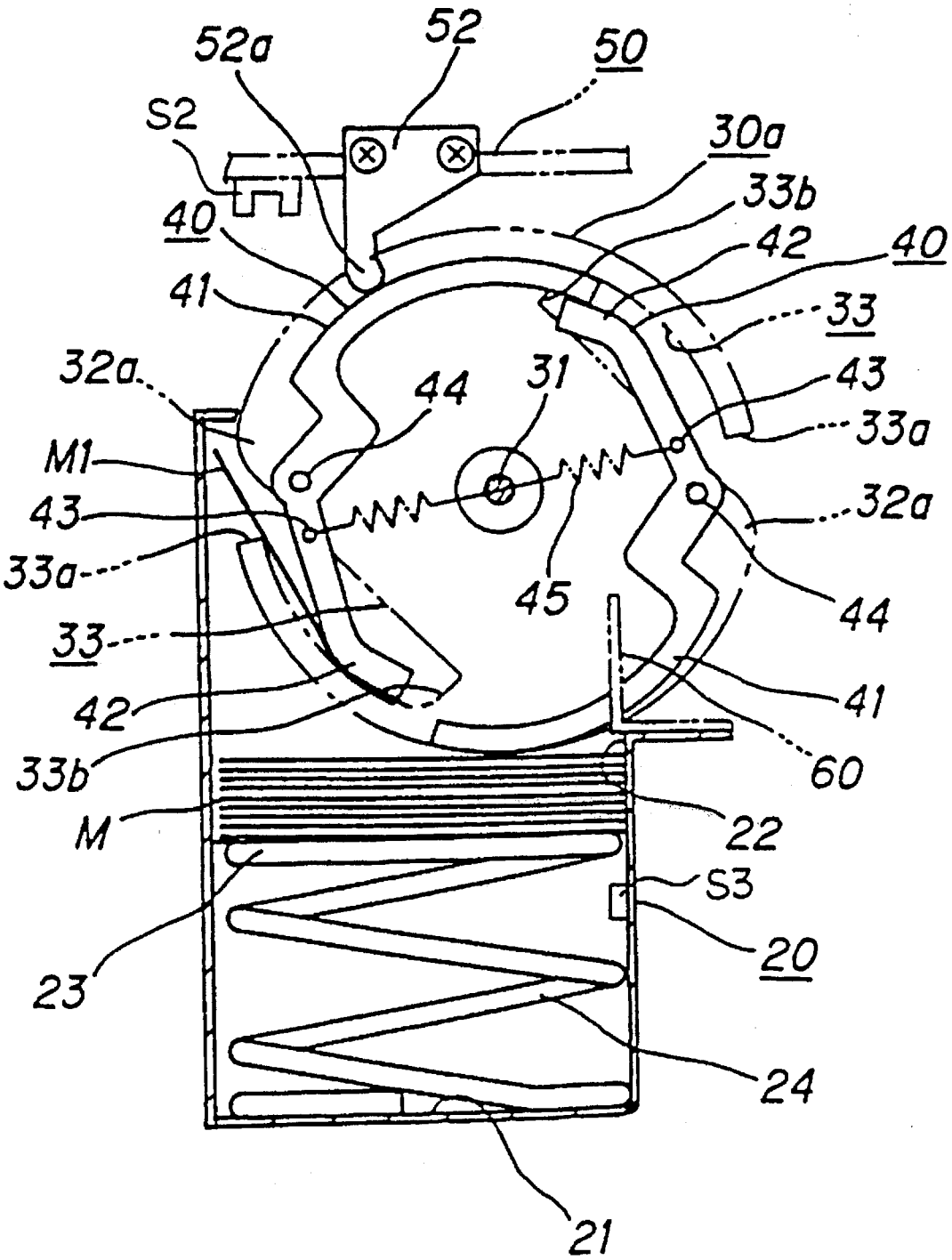
FIG. 4 is a transverse sectional view illustrating the operation of the paper slip storage system according to the embodiment of the invention.

When the rotation drum 30 rotates about 45 degrees counterclockwise from the angle shown in FIG. 3, it will be placed at the position shown in FIG. 4. At this time, the cam end 41 of the pressure arm member 40 engages the tip 52*a* of the plate member 52 and is pushed into the inside of the rotation drum 30. Therefore, the working end 42 of the pressure arm member 40 is angularly displaced clockwise on the shaft 44 corresponding to the angular displacement of the pressure arm member 40, whereby the working end 42 reaches the hold position against the urging force of the spring member 45. In this condition, the working end 42 presses the paper slip M against the inner wall of the channel 33 to clamp it, thereby preventing the paper slip M in the channel 33 from slipping out as the rotation drum 30 rotates.

Figure 5:
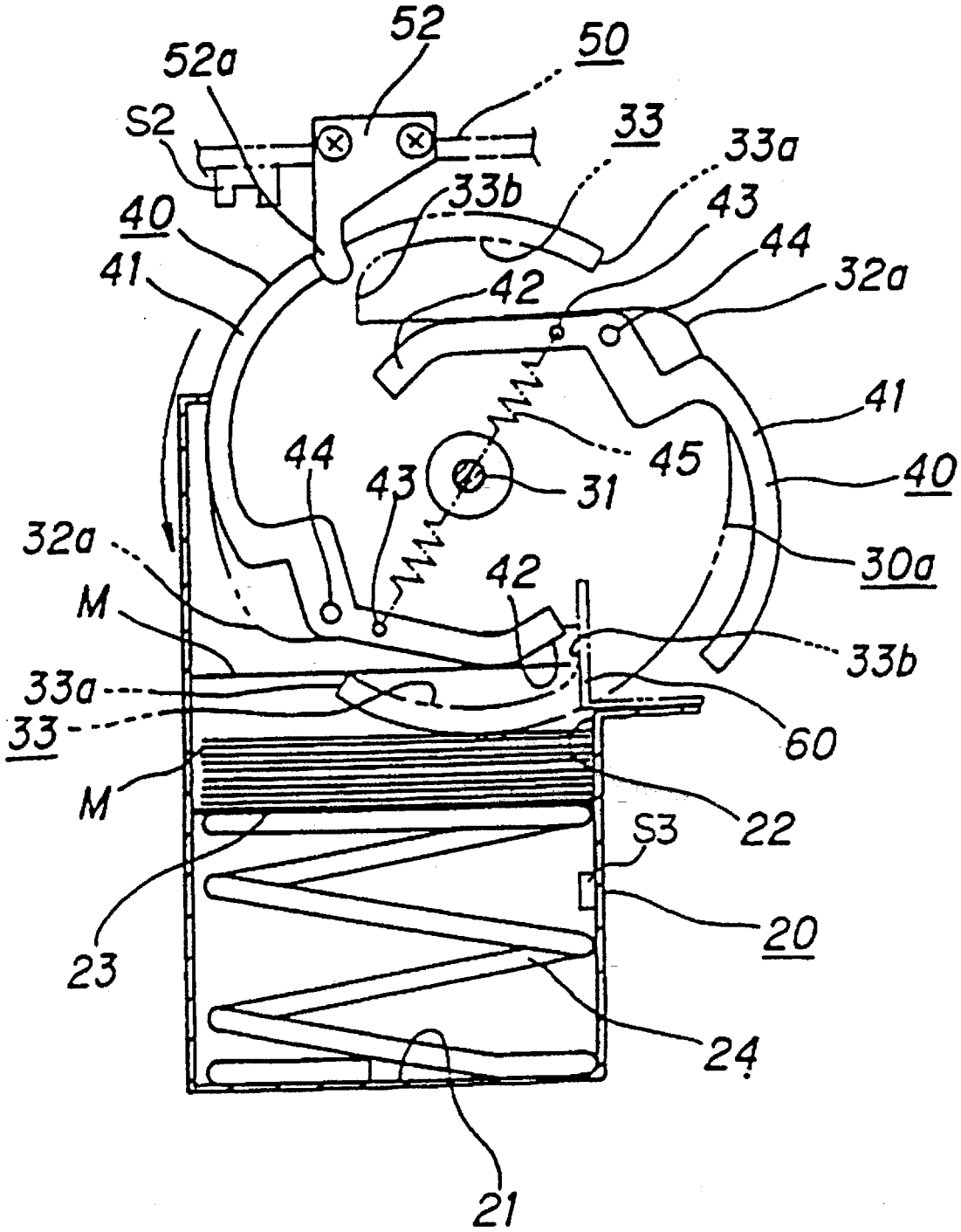
FIG. 5 is a transverse sectional view illustrating the operation of the paper slip storage system according to the embodiment of the invention.

Subsequently, when the rotation drum 30 rotates to the position shown in FIG. 5, the paper slip M caught in the channel 33 is moved to the opening 22 of the paper slip storage container 20 and placed at a position parallel to the paper slip holding plate 23 of the paper slip storage container 20. At this time, the cam end 41 of the pressure arm member 40 is detached from the tip 52*a* of the plate member 52. Thus, the working end 42 of the pressure arm member 40 is angularly displaced counterclockwise on the shaft 44 by the urging force of the spring member 45, whereby the working end 42 is placed away from the hold position and reaches the release position, releasing the pressure on the paper slip M.

Figure 6:
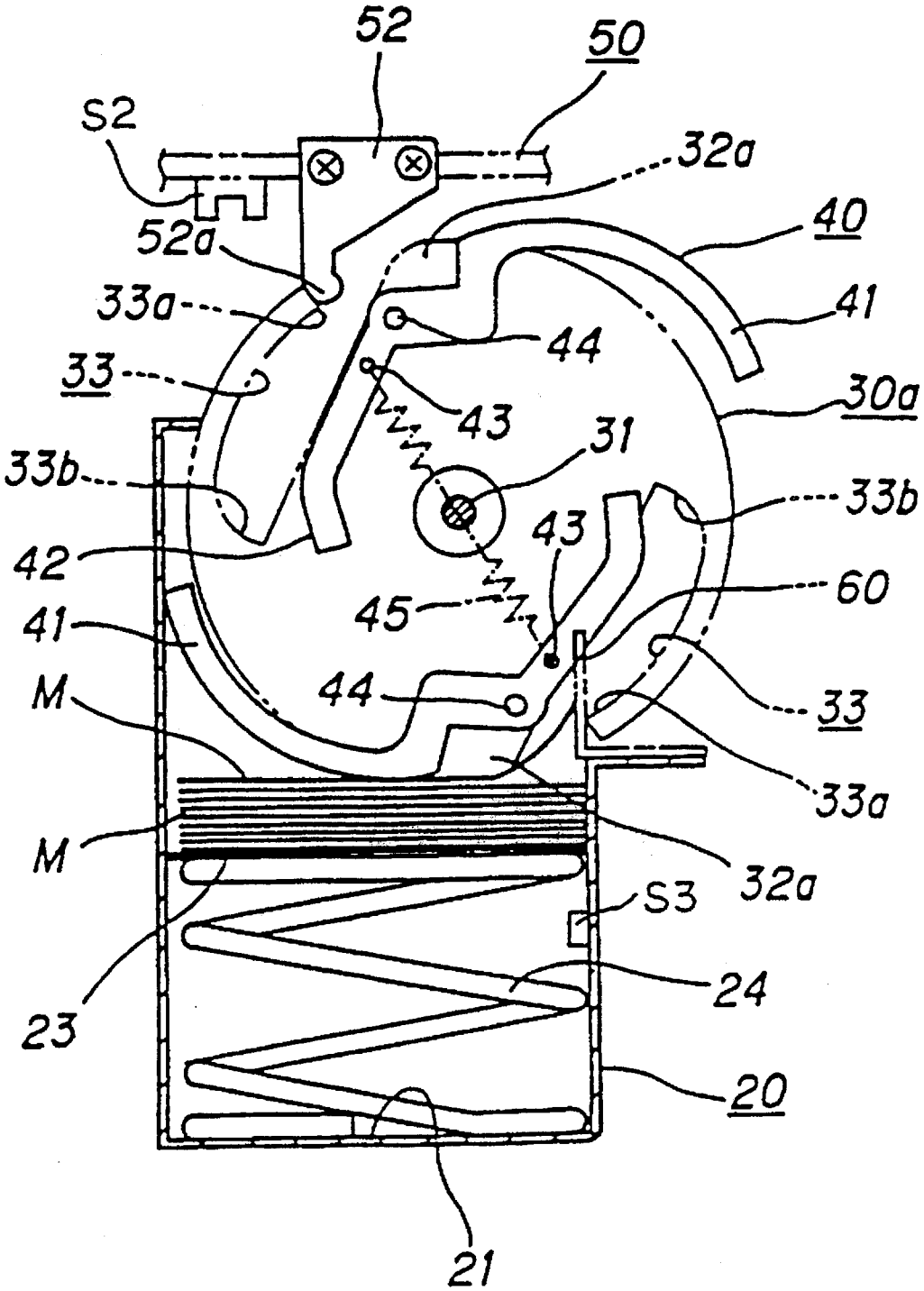
FIG. 6 is a transverse sectional view illustrating the operation of the paper slip storage system according to the embodiment of the invention.
Figure 7:
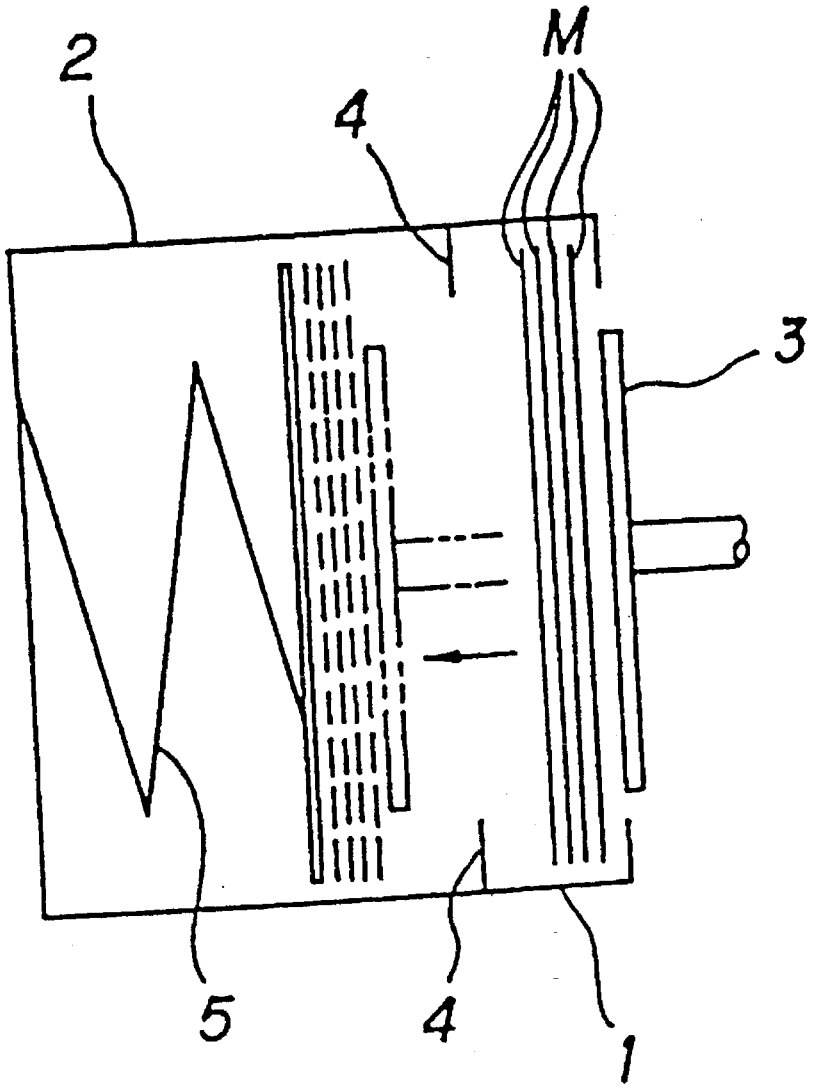
FIG. 7 is a schematic longitudinal sectional view showing a conventional example.

Further, when the rotation drum 30 rotates to the angle shown in FIG. 6, the paper slip stop member 60 strikes against the paper slip M in the channel 33 on the side of the paper slip storage container 20 where the rotation drum 30 protrudes, and passage of the paper slip M is blocked. As the rotation drum 30 further rotates, the channel 33 rotates, but rotation of the paper slip M is blocked by the paper slip stop member 60, and is thus discharged through the discharge port 33*a* of the channel 33 and remains in the paper slip storage container 20.

The paper pressure springs 24 press the paper slips M stacked in the paper slip storage container 20 towards the side of the rotation drum 30. When the rotation drum 30 rotates to the angle shown in FIG. 6, it presses the paper slip M by means of the pressure part 32*a* and puts it between the cylindrical face 32 and the paper slip pressure springs 24 to stack it on the paper slips M in the paper slip storage container 20.

Thus, as the rotation drum 30 rotates, the paper slip M slips out of the discharge port 33*a* of the channel 33 and is stored in the paper slip storage container 20. At this time, the paper slip pressure springs 24 press the paper slips M in the paper slip storage container 20 towards the side of the rotation drum 30, and thus the paper slips M can be arranged properly.

When the rotation drum 30 rotates 180 degrees from the angle in FIG. 3, the other channel 33 is set to a condition in which it can receive another paper slip M from the paper slip transport mechanism 70. After this, the same operation as described above is performed.

When the rotation drum 30 thus rotates to stack the paper slips in the paper slip storage Container 20, their weight causes the springs 24 to be compressed. Compression of the springs causes a part thereof to come in contact with the sensor S3, which then detects it and sends a detection signal to the controller C. When receiving this signal, the controller C stops the drive 73*b* and the drive motor 81. When the paper slips M in the paper slip storage container 20 are discharged from the container 20, the same operation as described above is repeated.

Thus, a space for only housing the rotation drum 30 would enable the rotation drum 30 to smoothly store paper slips in the paper slip storage container 20. Therefore, according to the invention, the installation space of the paper slip storage system can be made compact for effective use of space such as the inside of a gaming machine island in which the paper slip storage system is installed.

In the embodiment, the system includes two channels for housing paper slips, but one or three or more channels may be provided. In addition to paper such as bills and slips, flexible cards, etc., may be transported in the place of the paper slips.

Although the rotation drum is used in the embodiment, the invention is not limited to the drum. The paper slip housing portion (in the embodiment, the channels) needs only to be able to be angularly displaced to send a received paper slip to a storage container at a different angle position. Therefore, a basket or the like may be used in place of the channel to be rotated.

In the embodiment, the system comprises the rotation drum divided into two subdrums, but the invention is not limited to it. For example, a single drum or more than three subdrums can also be used.

Although a paper slip is inserted into the channel from the axial direction of the rotation drum in the embodiment, it may be inserted into the channel from the circumferential direction of the rotation drum.

Figure 8:
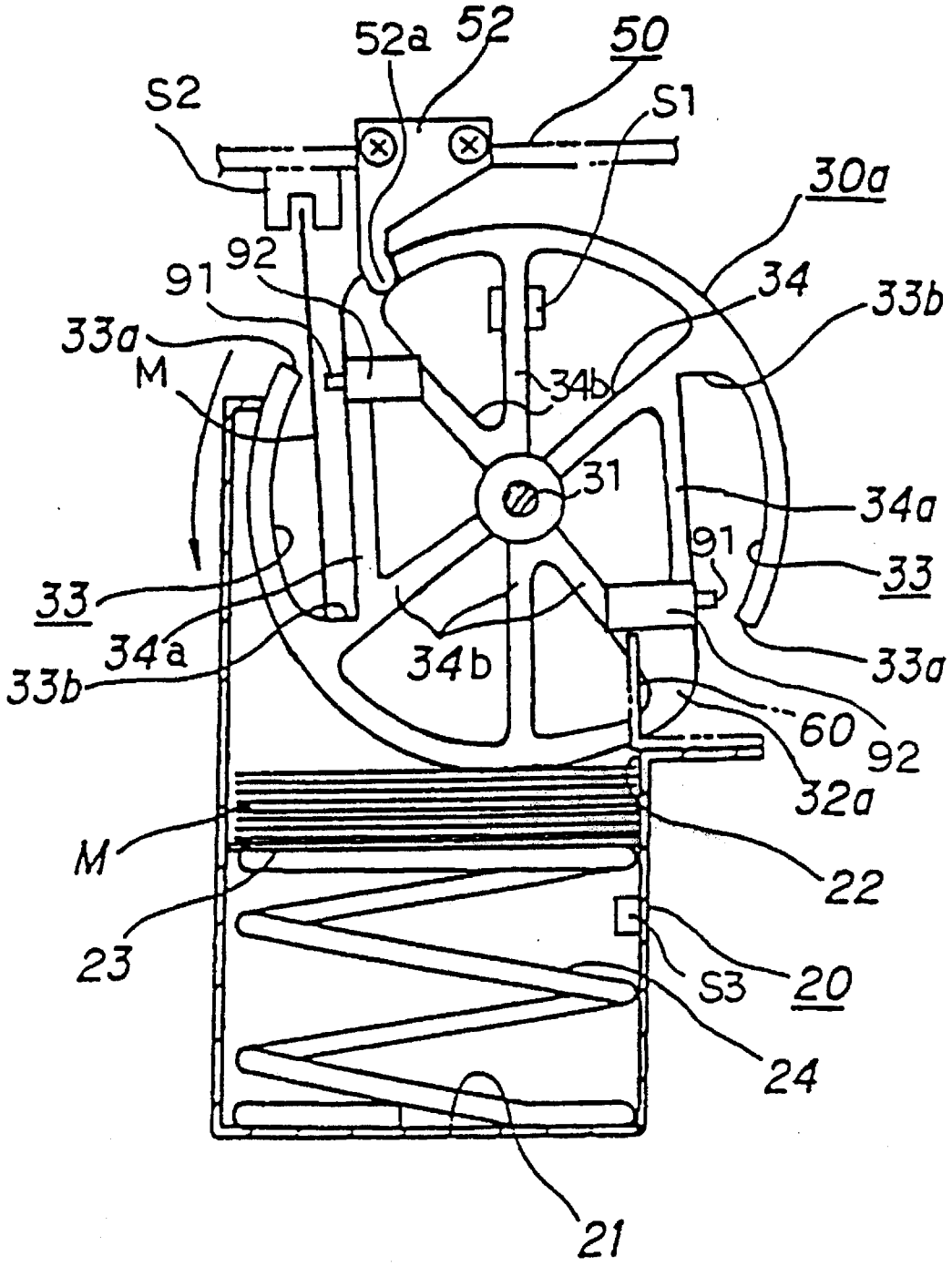
FIG. 8 is a transverse sectional view showing another example of a paper slip clamp mechanism.

In the embodiment, the pressure arm members 40 and 40 are used to clamp paper slips M. However, the invention is not limited to it. For example, pins 91 which can protrude and withdraw as desired in the channels 33 and a mechanism, such as solenoids 92, serving as a drive mechanism for driving protrusion and withdrawing of the pins are provided, as shown in FIG. 8. The solenoids 92 are controlled by the controller C so as to protruded and withdrawn in response to the rotation angle positions of the channels.

What is claimed is:

1. A paper slip storage system having a paper slip storage container being placed in conjunction with a transport mechanism for storing transported paper slips, wherein the improvement comprises:

a temporary housing section for receiving a transported paper slip and temporarily housing it;

a rotational displacement mechanism for rotionally displacing the temporary housing section for guiding the paper slip housed therein to a paper slip storage position of the paper slip storage container; and a separation mechanism for blocking rotation of the paper slip housed in said temporary housing section against operation of rotational displacement of said temporary housing section and separating the paper slip from said temporary housing section at the paper slip storage position of the paper slip storage container, said rotational displacement mechanism having a rotation body and a drive mechanism for rotationally driving said rotation body, said paper slip storage container having an area for stacking and storing paper slips separated from said temporary housing section and a mechanism being provided under said area for pressing the stacked paper slips in a direction of said rotation body, said paper slip pressing mechanism pressing the paper slips so that the uppermost one of the stacked paper slips comes into contact with an outer peripheral surface of said rotation body, said temporary housing having a slit-like opening along an axial direction on the outer peripheral surface of the rotation body, and said opening is cut as to extend to at least an end of the rotation body for accepting a paper slip along the axial direction of said rotation body.

2. The paper slip storage system as claimed in claim 1 wherein said paper slip storage container area for storing paper slips has an opening having a sectional form like a rectangle, and wherein said rotation body has an axial length shorter than a longitudinal length of the opening section and a diameter larger than a width direction of the opening section.

3. The paper slip storage system as claimed in claim 2 wherein said opening being provided in a size having a depth smaller than a height of a paper slip to be housed and made so as not to bend the paper slip when the paper slip to be housed therein.

4. The paper slip storage system as claimed in claim 2 wherein said rotation body is made of a rotation drum and said temporary housing section is a channel provided on said rotation drum.

5. The paper slip storage system as claimed in claim 4 wherein said rotation drum comprises a plurality of separate subdrums combined axially, further including in at least one of gaps between the subdrums, a clamp mechanism for temporarily fixing and holding a paper slip housed in said channel while the paper slip is guided to the paper slip storage position of said paper slip storage container after it has been received.

6. The paper slip storage system as claimed in claim 1 wherein said temporary housing section has a length in a rotation shaft direction of said rotation body, shorter than a length in the same direction of a paper slip housed in said temporary storage section, and wherein said separation mechanism consists of a paper slip stop member for blocking tangential movement of a paper slip, said paper slip stop member being placed at a position abutting against a part of a paper slip protruding outward from said temporary housing section when said temporary housing section is at the paper slip storage position of said paper slip storage container.

7. The paper slip storage system as claimed in claim 6 further including a clamp mechanism for temporarily fixing and holding a paper slip housed in said temporary housing section while the paper slip is guided to the paper slip storage position of said paper slip storage container after it has been received.

8. The paper slip storage system as claimed in claim 7 wherein two paper slip stop members are provided and placed on both sides of a rotation passage position of said temporary housing section.

9. The paper slip storage system as claimed in claim 8 comprising a plurality of said temporary housing sections which are equally spaced on said rotation body.

10. The paper slip storage system as claimed in claim 7 wherein said temporary housing section has a depth of about two thirds of the height of a paper slip to be housed therein.

11. A paper slip storage system having a paper slip storage container being placed in conjunction with a transport mechanism for storing transported paper slips, wherein the improvement comprises:

a temporary housing section for receiving a transported paper slip and temporarily housing it;

a rotational displacement mechanism for rotationally displacing the temporary housing section for guiding the paper slip housed therein to a paper slip storage position of the paper slip storage container;

a separation mechanism for blocking rotation of the paper slip housed in said temporary housing section against operation of rotational displacement of said temporary housing section and separating the paper slip from said temporary housing section at the paper slip storage position of the paper slip storage container; and a first sensor for detecting said temporary housing section being at a position where it can receive a paper slip;

said rotational displacement mechanism having a rotation body and a drive mechanism for rotationally driving said rotation body, said paper slip storage container having an area for stacking and storing paper slips separated from said temporary housing section and a mechanism being provided under said area for pressing the stacked paper slips in a direction of said rotation body, said paper slip pressing mechanism pressing the paper slips so that the uppermost one of the stacked paper slips comes into contact with an outer peripheral surface of said rotation body.

12. The paper slip storage system as claimed in claim 11 further including a second sensor for detecting said temporary housing section housing a paper slip.

13. The paper slip storage system as claimed in claim 12 further including a controller which controls the drive mechanism so as to stop rotation of said rotation body upon reception of a detection signal from said first sensor and controls the drive mechanism so as to rotate said rotation body upon reception of a detection signal from said second sensor.

14. The paper slip storage system as claimed in claim 13 wherein said controller outputs a signal externally for sending out the paper slip to said temporary housing section, upon reception of the detection signal from said first sensor.

15. The paper slip storage system as claimed in claim 14 further including a third sensor for detecting paper slips stored in said paper slip storage container reaching a specific amount and sending a detection signal to said controller.

16. The paper slip storage system as claimed in claim 15 wherein said paper slip pressing mechanism has a pressure spring.

17. The paper slip storage system as claimed in claim 16 wherein said third sensor detects compression of said pressure spring for detecting the paper slips reaching the specific amount.

18. A paper slip storage system having a paper slip storage container being placed in conjunction with a transport mechanism for storing transported paper slips, wherein the improvement comprises:

a temporary housing section for receiving a transported paper slip and temporarily housing it;

a rotational displacement mechanism for rotationally displacing the temporary housing section for guiding the paper slip housed therein to a paper slip storage position of the paper slip storage container; and a separation mechanism for blocking rotation of the paper slip housed in said temporary housing section against operation of rotational displacement of said temporary housing section and separating the paper slip from said temporary housing section at the paper slip storage position of the paper slip storage container, wherein said rotational displacement mechanism has a rotation body and a drive mechanism for rotationally driving said rotation body, wherein said paper slips storage container has an area for stacking and storing paper slips separated from said temporary housing section and a mechanism being provided under said area for pressing the stacked paper slips in a direction of said rotation body, wherein said paper slip pressing mechanism presses the paper slips so that the uppermost one of the stacked paper slips comes into contact with an outer peripheral surface of said rotation body, wherein said rotation body is made of a rotation drum and said temporary housing section is a channel provided on said rotation drum, wherein said rotation drum comprises a plurality of separate subdrums combined axially, further including in at least one of gaps between the subdrums, a clamp mechanism for temporarily fixing and holding a paper slip housed in said channel while the paper slip is guided to the paper slip storage position of said paper slip storage container after it has been received, and wherein said clamp mechanism has an arm member being supported swingably by at least any one of the subdrums for releasably restraining the paper slip housed in said channel and a working mechanism for causing said arm member to restrain and release the paper slip according to rotation angle positions of said channel.

19. The paper slip storage system as claimed in claim 18 wherein said separation mechanism consists of a paper slip stop member for blocking tangential movement of a paper slip, said paper slip stop member being placed at a position abutting against a part of a paper slip protruding outward from said channel when said channel is at the paper slip storage position of said paper slip storage container.

20. The paper slip storage system as claimed in claim 19 wherein two paper slip stop members are provided and placed on both sides of said rotation body.

21. The paper slip storage system as claimed in claim 18 wherein said arm member has a working end, for clamping a paper slip, on one end and a cam end, for swinging said arm member, on the other end, said working end being displaced between a hold position protruding into said channel and pressing the paper slip and a release position for releasing the paper slip, said cam end having a curve of a length corresponding to an angle range in which the paper slip is to be pressed, said curve protruding outward from the outer peripheral surface of said drum when said working end is at the release position.

22. The paper slip storage system as claimed in claim 21 wherein said working mechanism has a member for urging the working end side toward the release position side and a pressure member for abutting against said cam end and pressing when said channel is in the angle range in which the paper slip is to be pressed.

* * * * *